US005676295A

United States Patent [19]

Gelb

[11] Patent Number: 5,676,295

[45] Date of Patent: Oct. 14, 1997

[54] MOLDED RUBBER BASE FOR LUGGAGE

[75] Inventor: Steven Alan Gelb, Seattle, Wash.

[73] Assignee: Jansport Apparel Corporation, Wilmington, Del.

[21] Appl. No.: 455,240

[22] Filed: May 31, 1995

[51] Int. Cl.[6] ..... A45F 3/04

[52] U.S. Cl. ..... 224/629; 224/628; 383/121

[58] Field of Search ..... 224/627, 628, 224/629, 642, 644, 209; 190/103, 40, 903, 181 R, 124, 127; 206/315.1, 315.6, 315.3, 315.9; 383/121, 121.1; 150/127, 130

[56] References Cited

U.S. PATENT DOCUMENTS

| | | | |
|---|---|---|---|
| D. 167,913 | 10/1952 | Stark | D3/255 |
| 2,751,955 | 10/1956 | Nahon | 206/315.6 |
| 2,865,421 | 12/1958 | Walsh . | |
| 3,578,115 | 5/1971 | Schneider . | |
| 3,622,056 | 11/1971 | Droeger | 224/629 |
| 3,902,640 | 9/1975 | Geiben | 224/629 |
| 4,041,618 | 8/1977 | Famolare, Jr. | 36/32 R |
| 4,082,208 | 4/1978 | Lane, Jr. | 224/629 |
| 4,137,653 | 2/1979 | Famolar, Jr. | 36/3 B |
| 4,343,057 | 8/1982 | Bensley | 36/101 |
| 4,377,042 | 3/1983 | Bauer | 36/15 |
| 4,420,103 | 12/1983 | Douglass . | |
| 4,479,595 | 10/1984 | Opsal | 224/644 |
| 4,550,510 | 11/1985 | Stubblefield | 36/3 B |
| 4,961,522 | 10/1990 | Weber . | |
| 5,176,253 | 1/1993 | Perrin et al. | 206/315.3 |
| 5,289,906 | 3/1994 | Guidi | 190/127 |
| 5,402,883 | 4/1995 | Shin | 206/315.6 |
| 5,518,315 | 5/1996 | Nichols | 383/121 |

FOREIGN PATENT DOCUMENTS

| | | | |
|---|---|---|---|
| 2018895-A | 12/1991 | Canada | 206/315.1 |
| 801578 | 11/1951 | Germany | 224/209 |
| 566843 | 9/1957 | Italy | 224/209 |
| 56-155733 | 12/1981 | Japan | 383/121 |

*Primary Examiner*—Henry J. Recla
*Assistant Examiner*—Greg Vidovich
*Attorney, Agent, or Firm*—Pennie & Edmonds LLP

[57] ABSTRACT

An integral, molded rubber base for a backpack. This base is connected to the fabric body portion of the backpack. A tread or lug sole pattern is provided on the bottom and sides of the molded rubber base. The back surface of the base is contoured to curve around the user's back, thus providing more comfort than a traditional straight back.

22 Claims, 19 Drawing Sheets

MOLDED RUBBER BASE FOR LUGGAGE

This invention relates to luggage, such as daypacks, backpacks, utility packs and the like. Specifically, this invention relates to a durable, waterproof, molded rubber base for backpacks.

BACKGROUND OF THE INVENTION

Multi-purpose bags for daily use, sports or travel, have long been known in the art. Users of luggage such as backpacks, utility packs and the like, are very concerned about durability of the bag with prolonged use over a period of time. In order to increase durability, daypacks or backpacks are often provided with leather bases, and such bags are widely available and are quite popular.

Consumers using such bags are also quite concerned with protecting the contents of these bags from the elements, particularly water. However, daypacks or backpacks with leather bases are usually not waterproof because most leather is not waterproof. In addition, the leather bases or fabric bases are generally sewn somewhere along the bottom of the backpack, and these seams permit entry of water into the luggage. In addition, if the backpack is placed in a puddle or in snow or slush, there is no protection that prevents moisture from entering the bag.

Most backpacks are also soft on the bottom and do not stand up on the ground unless supported by the contents on the inside. In addition, dirt that settles on the bottom of the bag with a leather base does not come off easily and may rub onto the user's clothing.

SUMMARY OF THE INVENTION

The present invention addresses the problems outlined above by capitalizing on the technology of molded rubber to increase the functionality of luggage, such as backpacks and the like. As a result, the bottom of the backpack which undergoes the greatest wear and tear is made considerably durable. The molded rubber, single piece construction ensures the contents of the backpack are maintained waterproof. In addition, the rubber base wraps around all four sides without any sewing seams on the bottom and prevents the entry of water into the backpack from the bottom. By using a molded rubber base which is flat and stiff, these backpacks can stand up on the ground making packing and unpacking much easier. Also, dirt that settles on the bottom of the pack can be cleanly wiped off before it rubs onto the user's clothing.

A tread or lug sole pattern is provided on the bottom and sides of the molded rubber base and a number of benefits accrue from providing this tread pattern. They allow for a larger area of the base to touch the ground without making the entire bottom thick and heavy. These large area lugs increase durability and extend the useful life of the luggage. The lug sole or tread pattern also evokes the style and durability of hiking boots in the eyes of the consumer and adds to its appeal.

The present invention also provides for laterally and vertically contouring the back surface of the molded rubber base in order to curve the base of the bag around the user's back, thus providing more comfort than a traditional straight back. The invention also provides pads located on the contoured back surface of the rubber base separated by vertical spacings. Air passes through these vertical spacings or channels and thus keeps the backpack cooler than a solid back when carried by the user on his back. Additionally, the pads on the contoured back surface have a smooth texture providing comfort to the user while carrying the luggage.

The inside of the molded rubber base has a cross-hatched pattern of braces. These braces are raised a few millimeters above the bottom surface and thus, keep the contents of the bag away from the bottom surface of the luggage. This ensures that should any dirt, water, or moisture enter the luggage and settle at the bottom, the contents are still maintained dry since they are kept away from the very bottom surface of the bag. In addition, the cross braces provide a significant degree of stiffness to the bottom with relatively little increase in weight.

The present invention also provides for a sewing area at the top of the molded rubber base to attach the base to the body portion of the luggage. This sewing area is textured inside to allow it to flow more smoothly through the sewing machines.

DETAILED DESCRIPTION OF THE INVENTION

Figure 1:
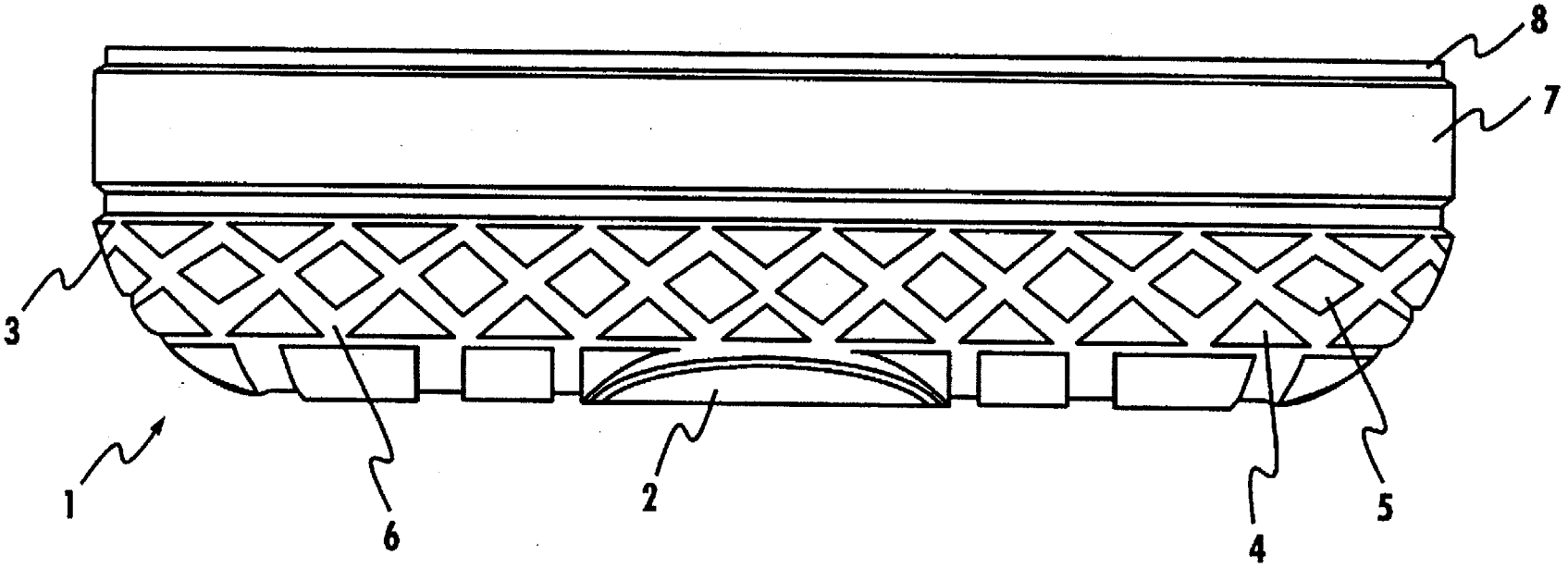
FIG. 1 is a front view of one embodiment of the base for the backpack.

Referring now to the drawings in detail, FIGS. 1–5 show one embodiment of the molded rubber base 1 of this invention. The base is a single, integrally molded piece without any sewing seams along the sides or the bottom. The base comprises a bottom 2 and four opposed sidewalls 3 with the bottom 2 connecting up to the sidewalls 3 to form a monolithic, molded structure. The base has a tread or lug sole pattern along the sidewalls 3 and the bottom 2. The tread pattern comprises triangular pads 4 and diamond-shaped pads 5 being separated by a cross-hatch pattern of channels 6. The channels 6 are depressed a few millimeters below the outside surface and thus form the tread pattern shown in FIG. 1.

The top portion 7 of the sidewalls 3 is unpatterned and is a circular strip extending all around on the from and the sides. At the very top of the base, a sewing area 8 is created to attach the base to the upper body of the backpack and to allow the base to flow through the sewing machines smoothly. If required, this sewing area 8 can be made thinner than the thickness of the base in other areas to facilitate ease in sewing.

Figure 2:
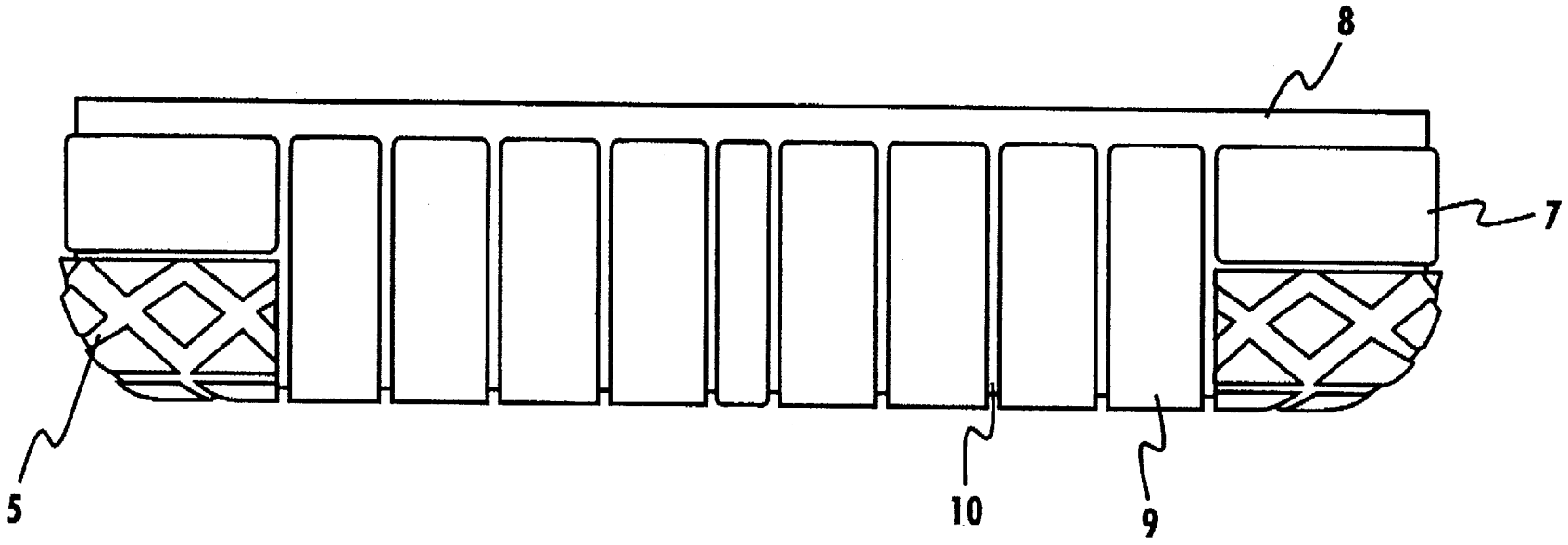
FIG. 2 is a back view of the embodiment shown in FIG. 1.

As shown in FIG. 2, the tread pattern is modified to provide large pads 9 on the contoured back surface of the rubber base separated by vertical spacings or channels 10. Air passes through these vertical spacings or channels 10 and thus keeps the backpack cooler than a solid back design when carried by the user on his back. Additionally, the pads on the contoured back surface have a smooth texture providing comfort to the user while carrying the backpack. The tread pattern 5 seen in FIG. 1 wraps around the back and is seen to a limited extent in FIG. 2. The top portion of the sidewalls 7 is interrupted by the vertical pads 9 which extend all the way to the sewing area 8 at the top.

Figure 3:
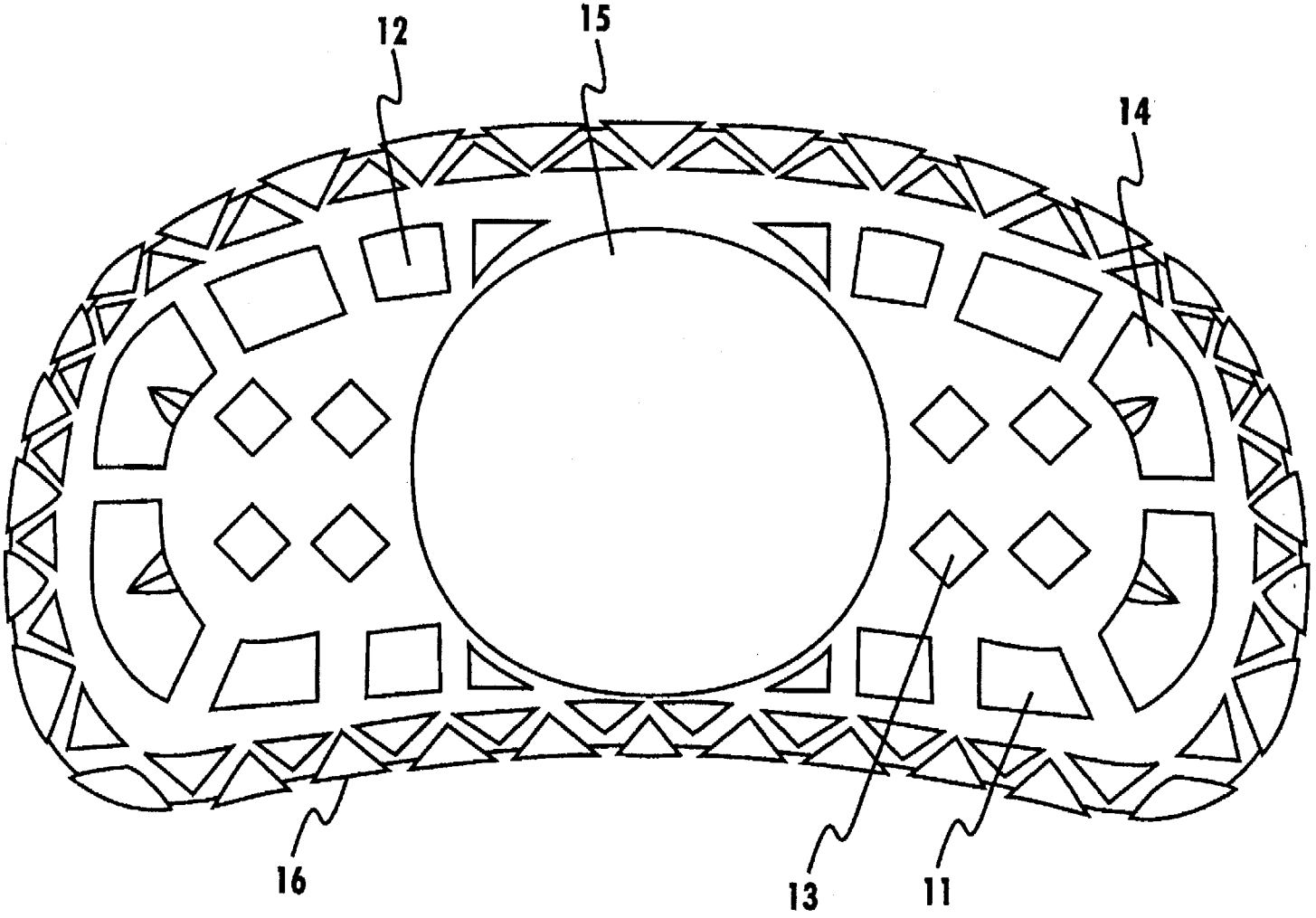
FIG. 3 is a bottom view of the embodiment shown in FIG. 1.
Figure 4:
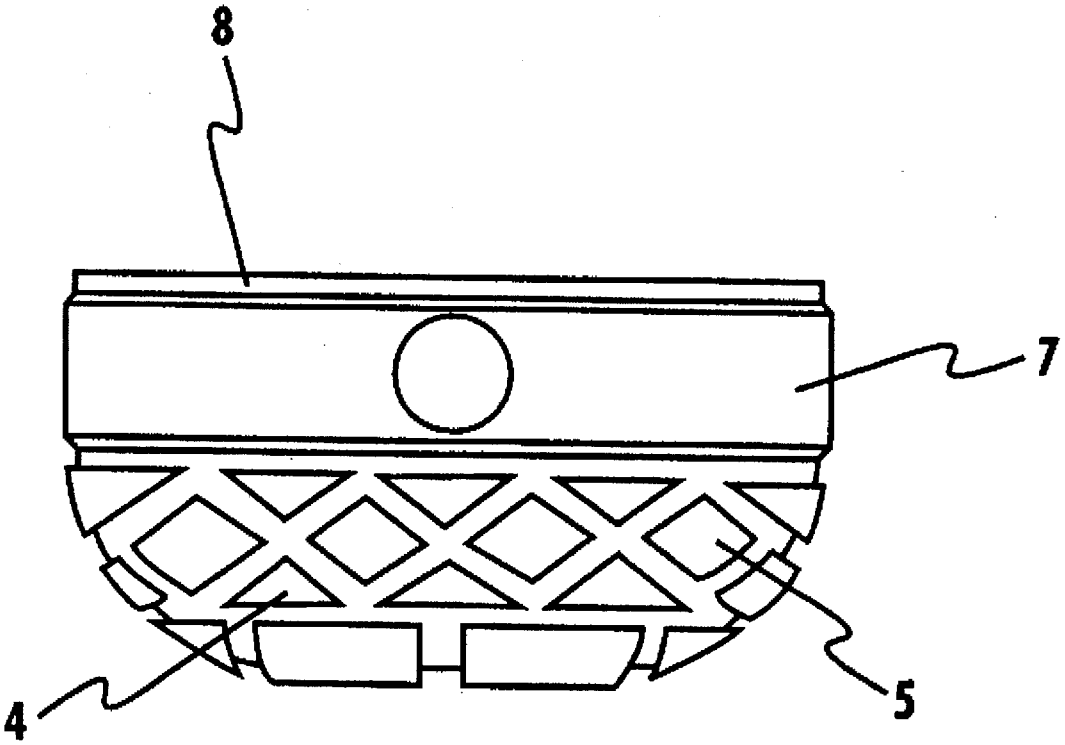
FIG. 4 is a side view of the embodiment shown in FIG. 1.

The tread pattern seen in FIG. 1 continues to the bottom side of the base (see FIG. 3). The variously shaped rubber pads 11, 12, 13 and 14 created by the tread pattern on the bottom allow for a larger area of the base to touch the ground without making the entire bottom thick and heavy. These large area lugs increase durability and extend the useful life of the backpack. A circular area 15 is created in the bottom to carry the backpack manufacturer's identification or trademark. Further, as seen in FIG. 3, the back surface 16 of the base is laterally and vertically contoured in order to shape the base of the bag around the user's back and thus provide more comfort than a traditional straight back.

The same tread pattern on the front side of the base in FIG. 1 is continued along the sides of the backpack (see FIG. 4) with the triangular 4 and diamond shaped pads 5 being separated by a cross-hatch pattern of channels/spacings. The circular sewing area 7 extends all around at the very top of the base and is used to connect the base to the body portion of the luggage.

Figure 5:
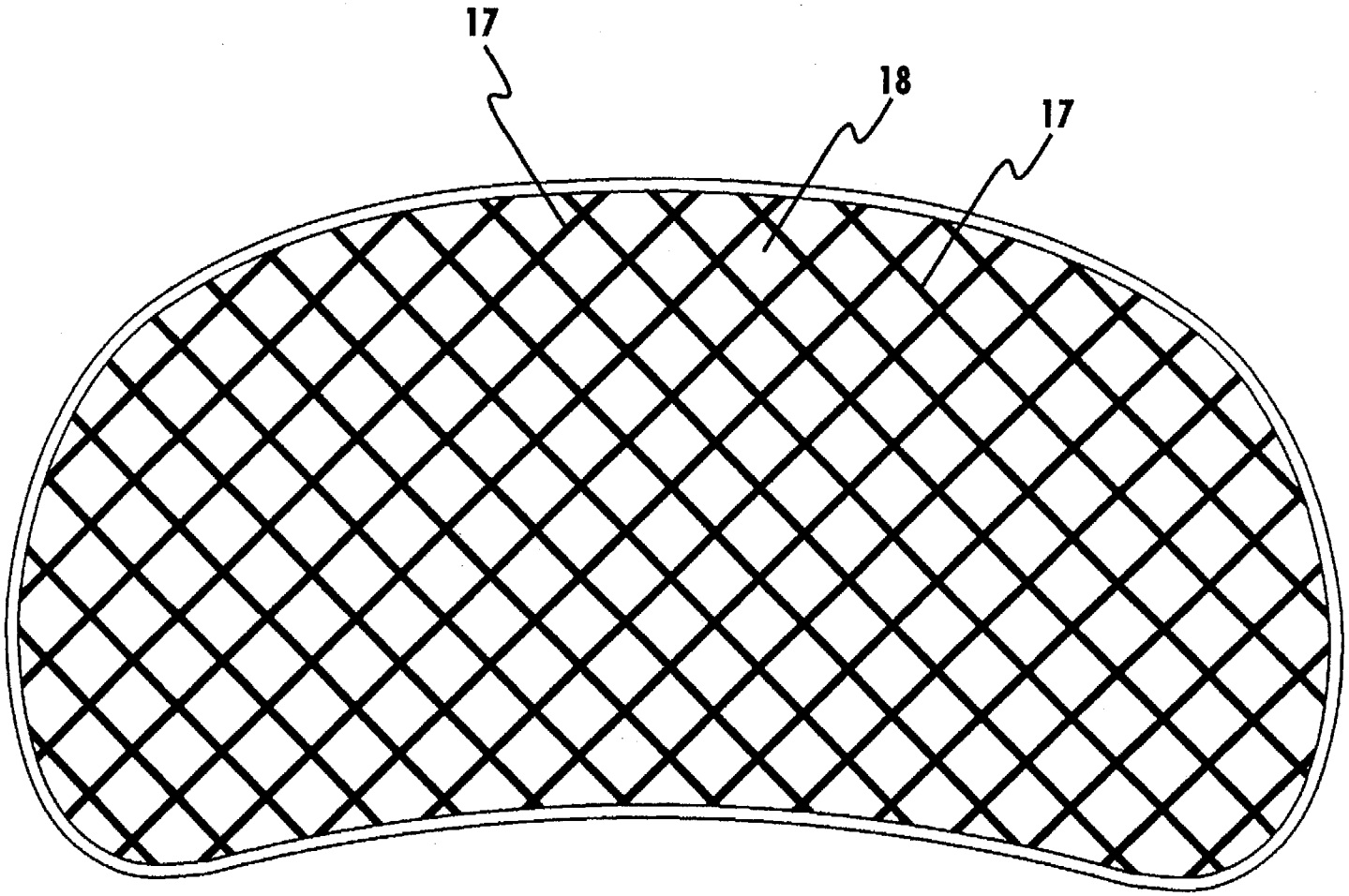
FIG. 5 is a top view of the embodiment shown in FIG. 1.

As seen in FIG. 5, the inside of the molded rubber base has a cross-hatched pattern of braces 17. These braces 17 are raised a few millimeters above the bottom surface 18 and thus keep the contents of the bag away from the bottom surface 18 of the backpack. This ensures that should any dirt, water, or moisture enter the luggage and settle at the bottom, the contents, which rest on the braces 17, are still maintained dry since they are kept away from the very bottom surface 18 of the bag. In addition, the braces 17 provide a significant degree of stiffness to the bottom with relatively little increase in weight.

Figure 6:
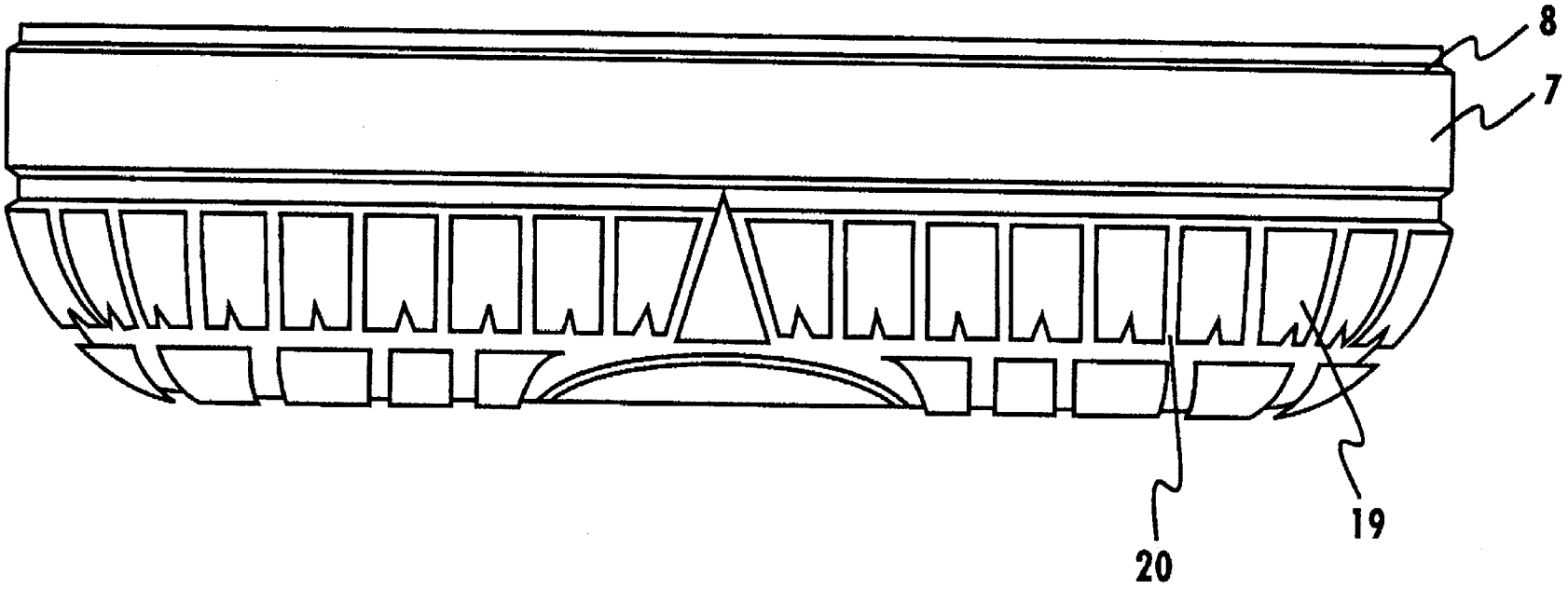
FIG. 6 is a front view of a second embodiment of the base for the backpack.
Figure 7:
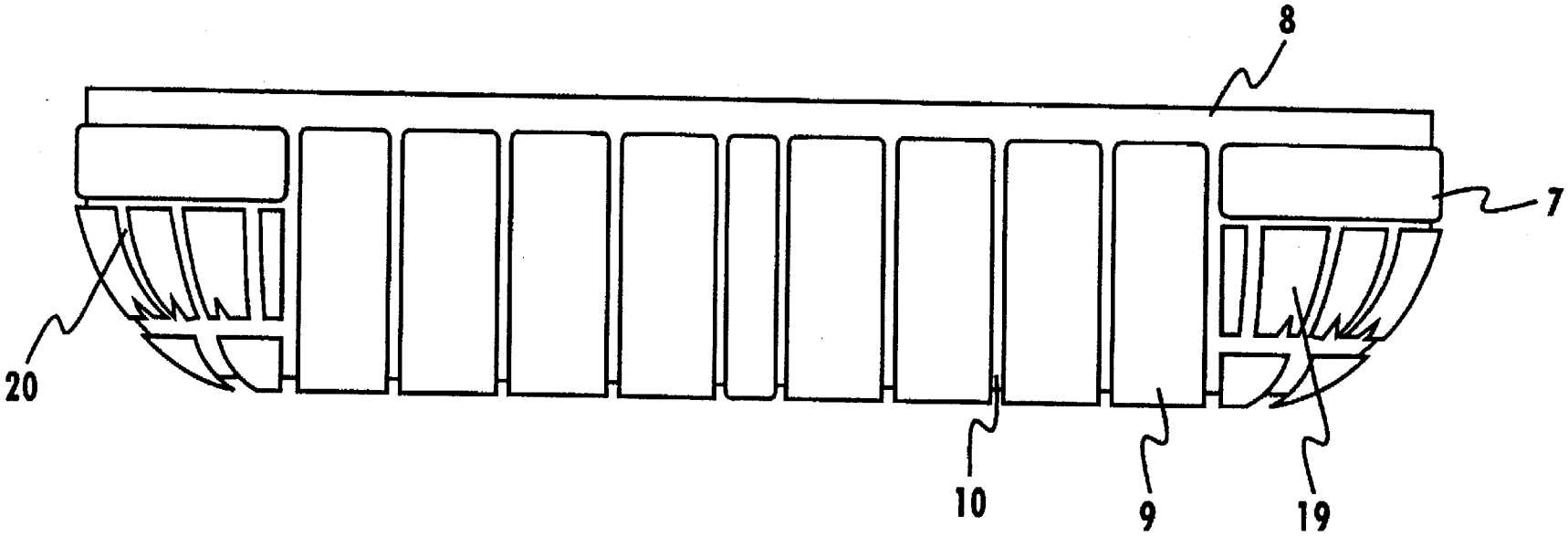
FIG. 7 is a back view of the second embodiment shown in FIG. 6.

FIG. 6 is a front view of a second embodiment of the base for the backpack of this invention. The differences between the first and second embodiment lie in the pattern of the tread on the bottom and sides of the base. The tread pattern comprises rectangular pads 19 separated by vertical spacings/channels 20. The back side of the second embodiment is shown in FIG. 7 and is substantially similar to the back side of the first embodiment shown in FIG. 2 and provides the same large pads 9 separated by vertical channels 10 for air flow and ventilation. The back side of the base is contoured to fit the back side of a user's back and to provide comfort.

Figure 8:
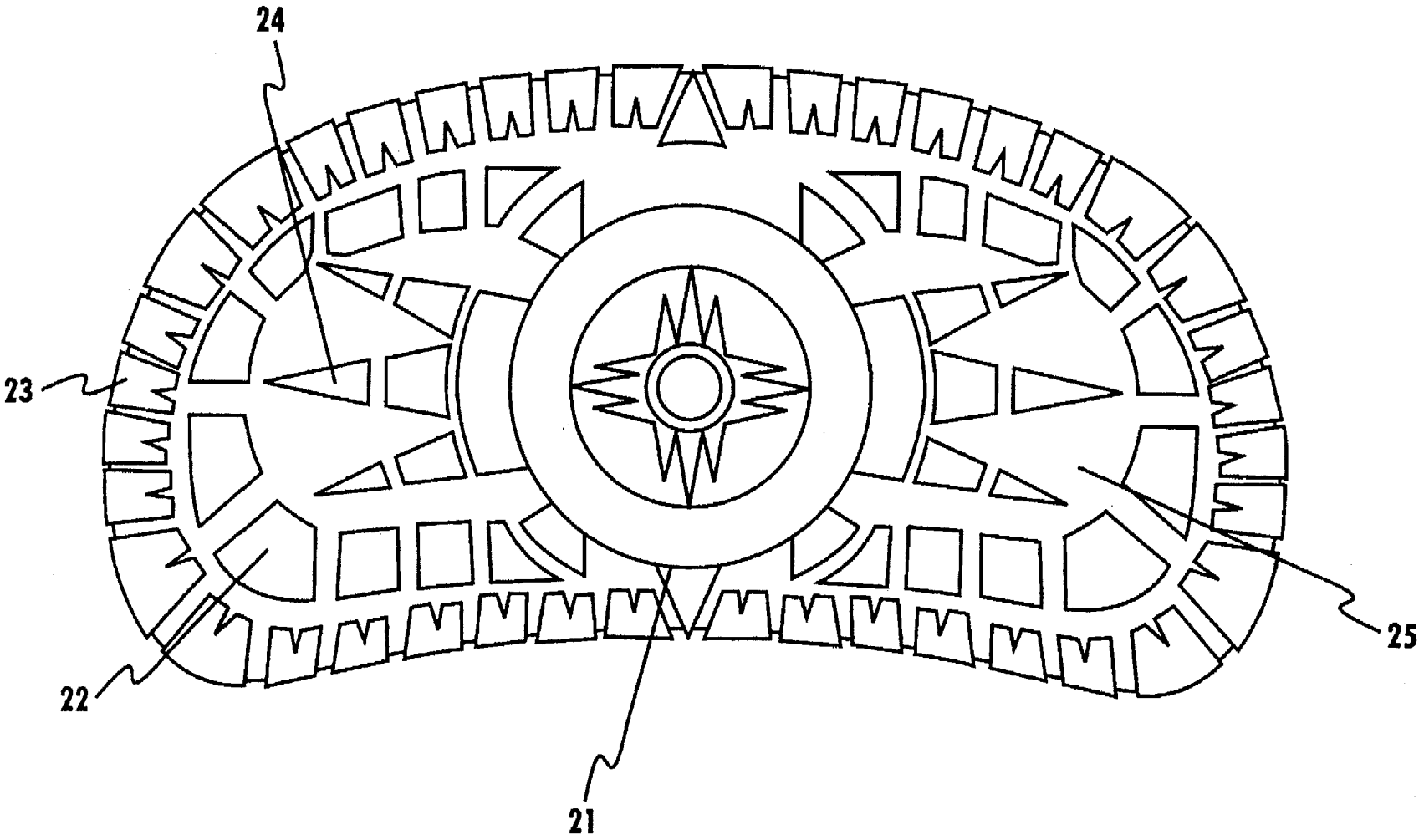
FIG. 8 is a bottom view of the second embodiment shown in FIG. 6.
Figure 9:
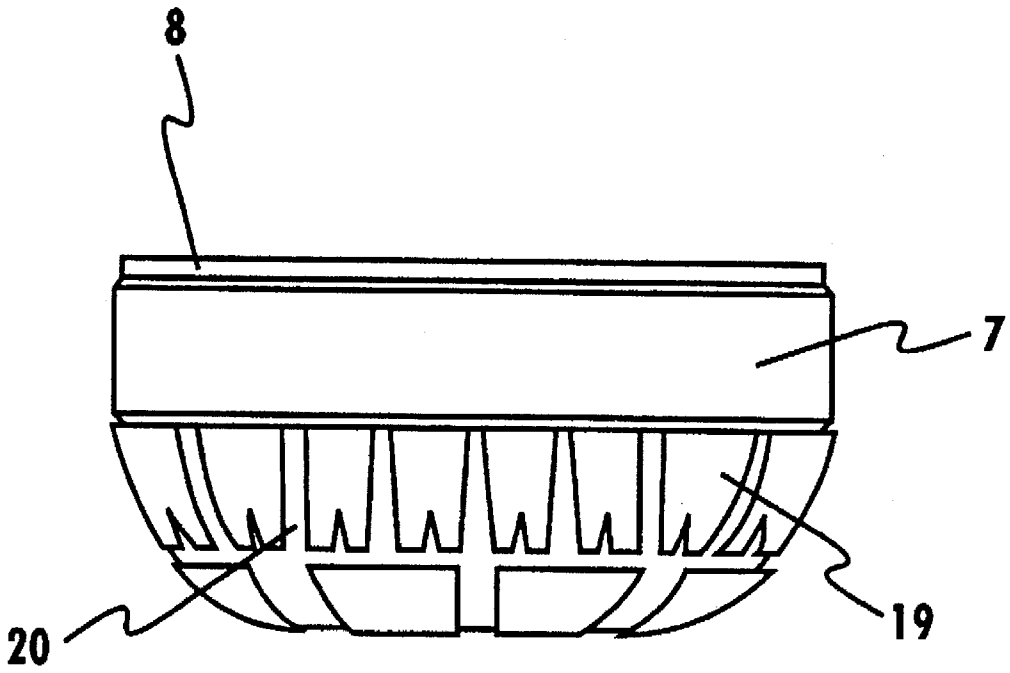
FIG. 9 is a side view of the second embodiment shown in FIG. 6.

FIG. 8 shows a bottom view of the second embodiment of this invention as being somewhat different from that of the first embodiment shown in FIG. 3. The tread pattern on the side, as seen in FIG. 9, is the same as on the front side (see FIG. 6).

Finally, the inside of the molded rubber base in the second embodiment has a cross-hatched pattern of braces 17 that is the same as in the first embodiment (see FIG. 5). These braces 17 are raised a few millimeters above the bottom surface 18 of the luggage and thus keep the contents of the luggage away from the bottom surface 18.

Figure 10:
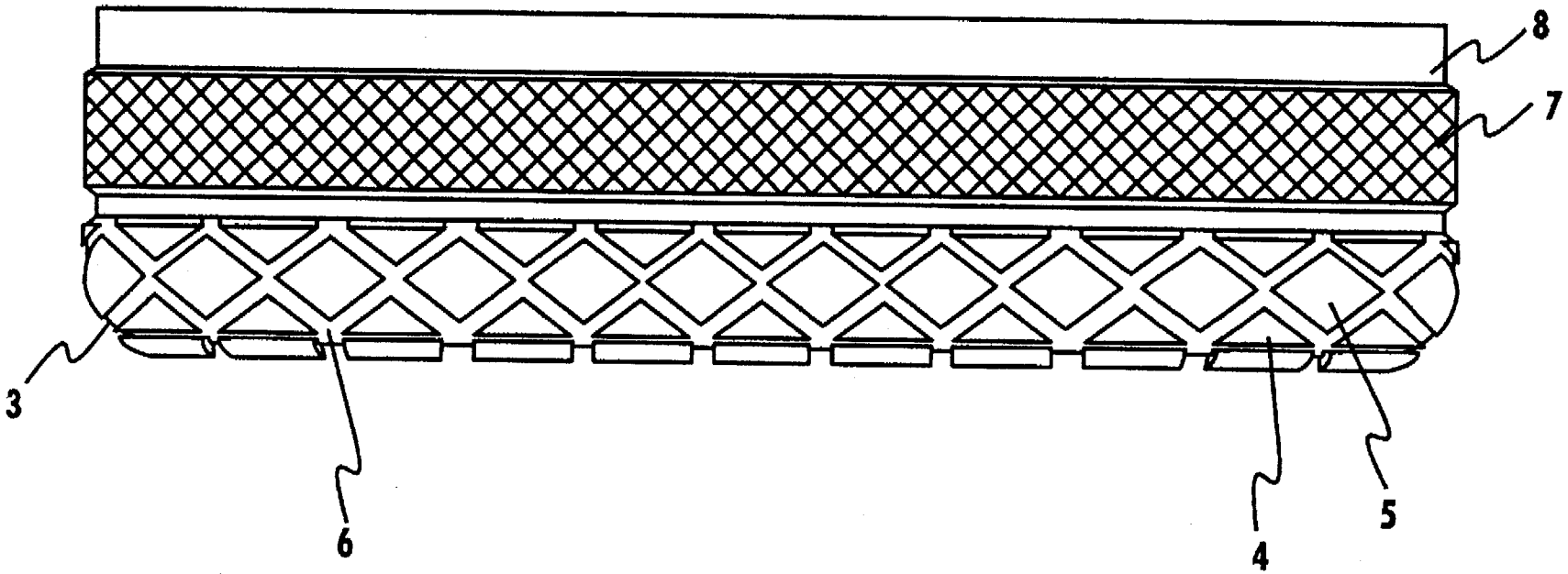
FIG. 10 is a front view of a third embodiment of the base for the backpack.
Figure 11:
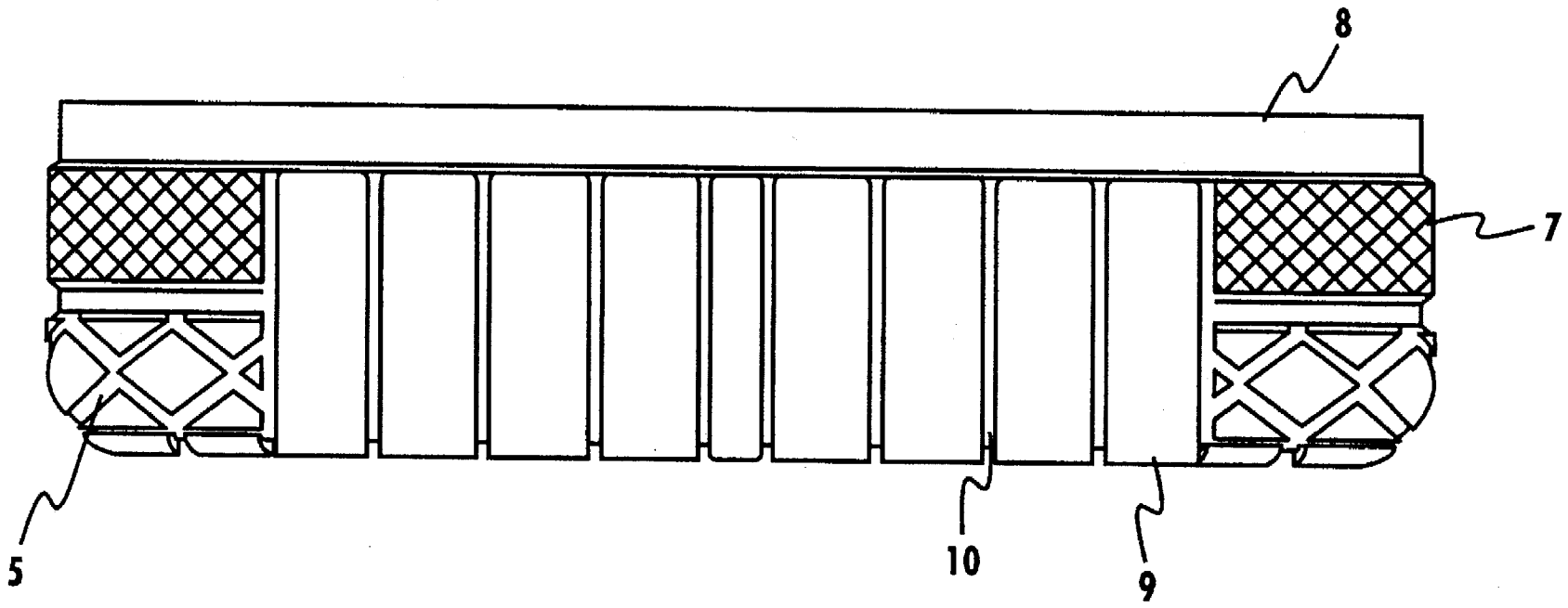
FIG. 11 is a back view of the third embodiment shown in FIG. 10.

FIG. 10 is a front view of a third embodiment of the base for the backpack of this invention. The top portion 7 of the sidewalls 3 has a cross-hatch pattern, whereas in the previous two embodiments this top portion 7 was unpatterned. The tread pattern comprises diamond-shaped pads 5 and triangular pads 4 separated by a cross-hatch pattern of channels 6. The back side of this embodiment is shown in FIG. 11. But for the patterned top portion 7 of the sidewalls 3, the back side is substantially similar to the back side of the first embodiment shown in FIG. 2. The back side of this embodiment also provides the same large pads 9 separated by vertical channels 10 for air flow and ventilation. In addition, the back side of the base is contoured to fit the back side of a user's back and to provide comfort.

Figure 12:
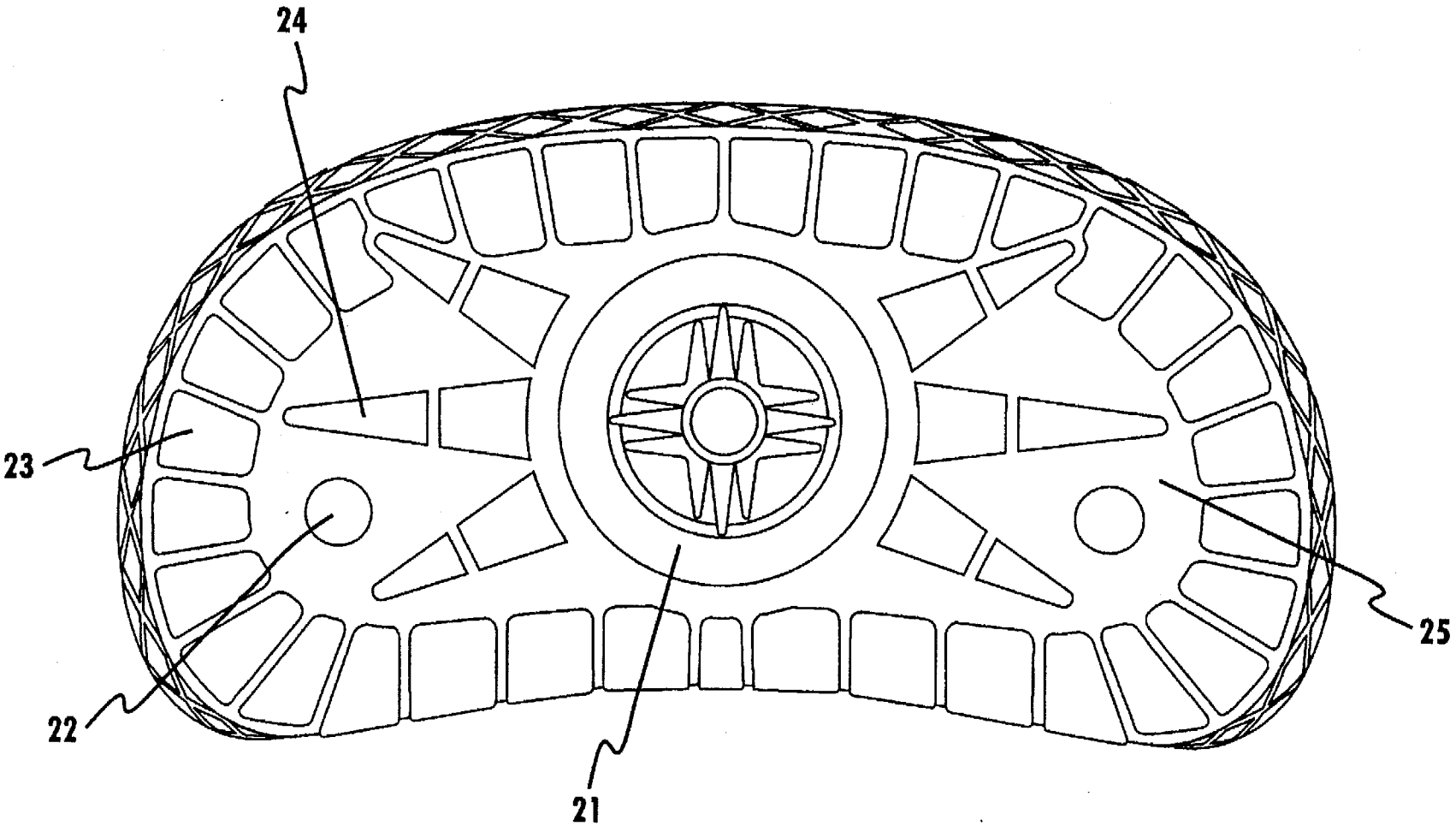
FIG. 12 is a bottom view of the third embodiment shown in FIG. 10.
Figure 13:
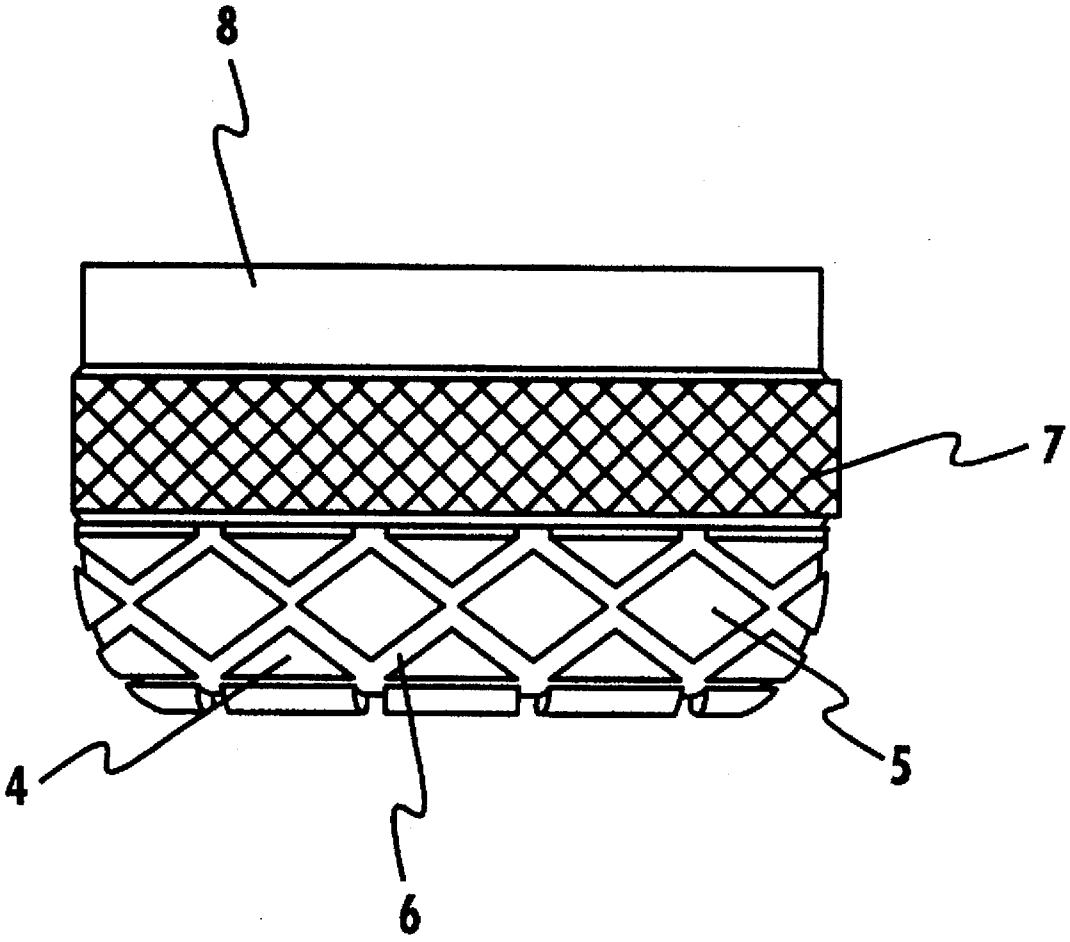
FIG. 13 is a side view of the third embodiment shown in FIG. 10.

FIG. 12 shows a bottom view of the third embodiment of this invention and is similar to the bottom view of the second embodiment seen in FIG. 8. The tread pattern on the side, as seen in FIG. 13, is the same as on the front side (see FIG. 10).

The inside of the molded rubber base in the third embodiment has a cross-hatched pattern of braces 17 that is the same as in the first and second embodiments (see FIG. 5). These braces 17 are raised a few millimeters above the bottom surface 18 of the luggage and thus keep the contents of the luggage away from the bottom surface 18.

Figure 14:
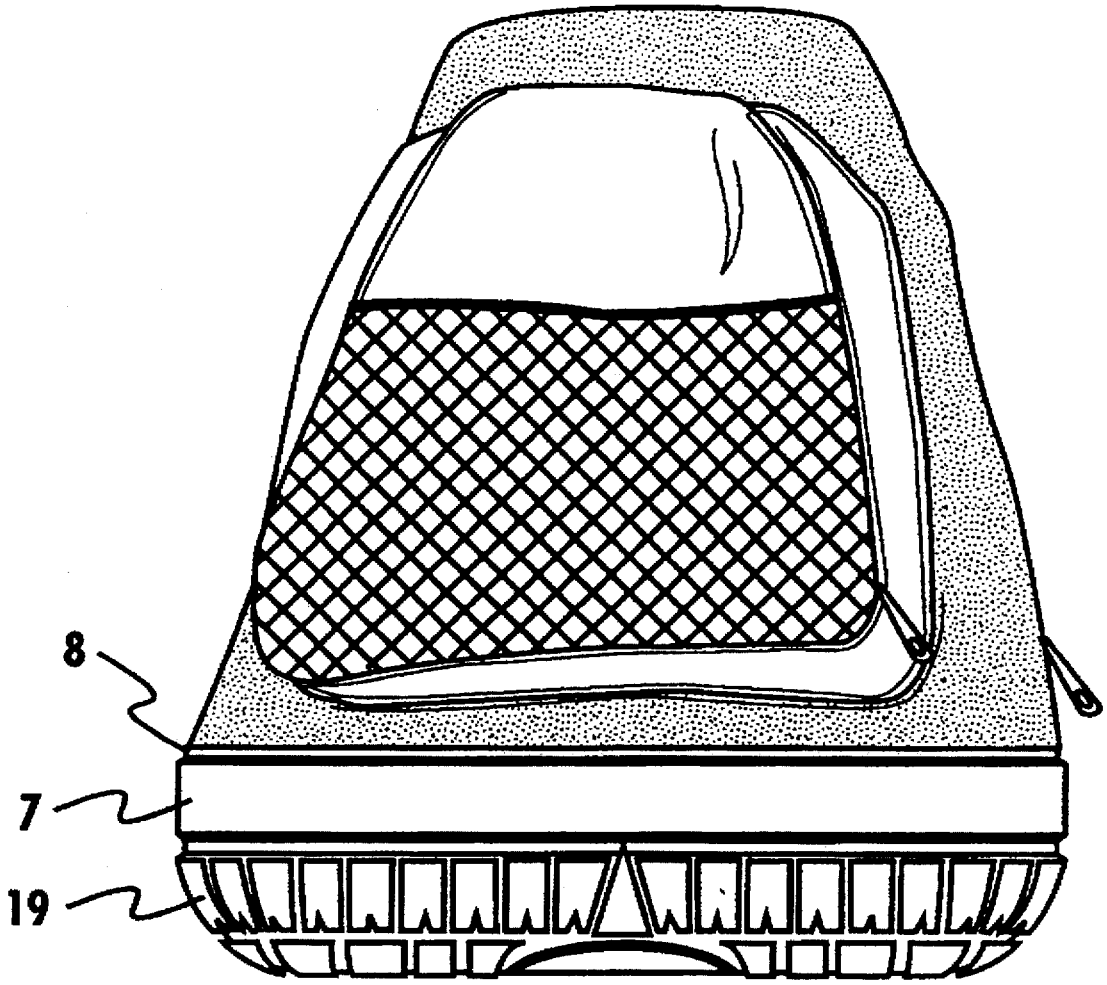
FIG. 14 is a front perspective view of a backpack with the molded rubber base of the second embodiment (see FIG. 6) of this invention.
Figure 15:
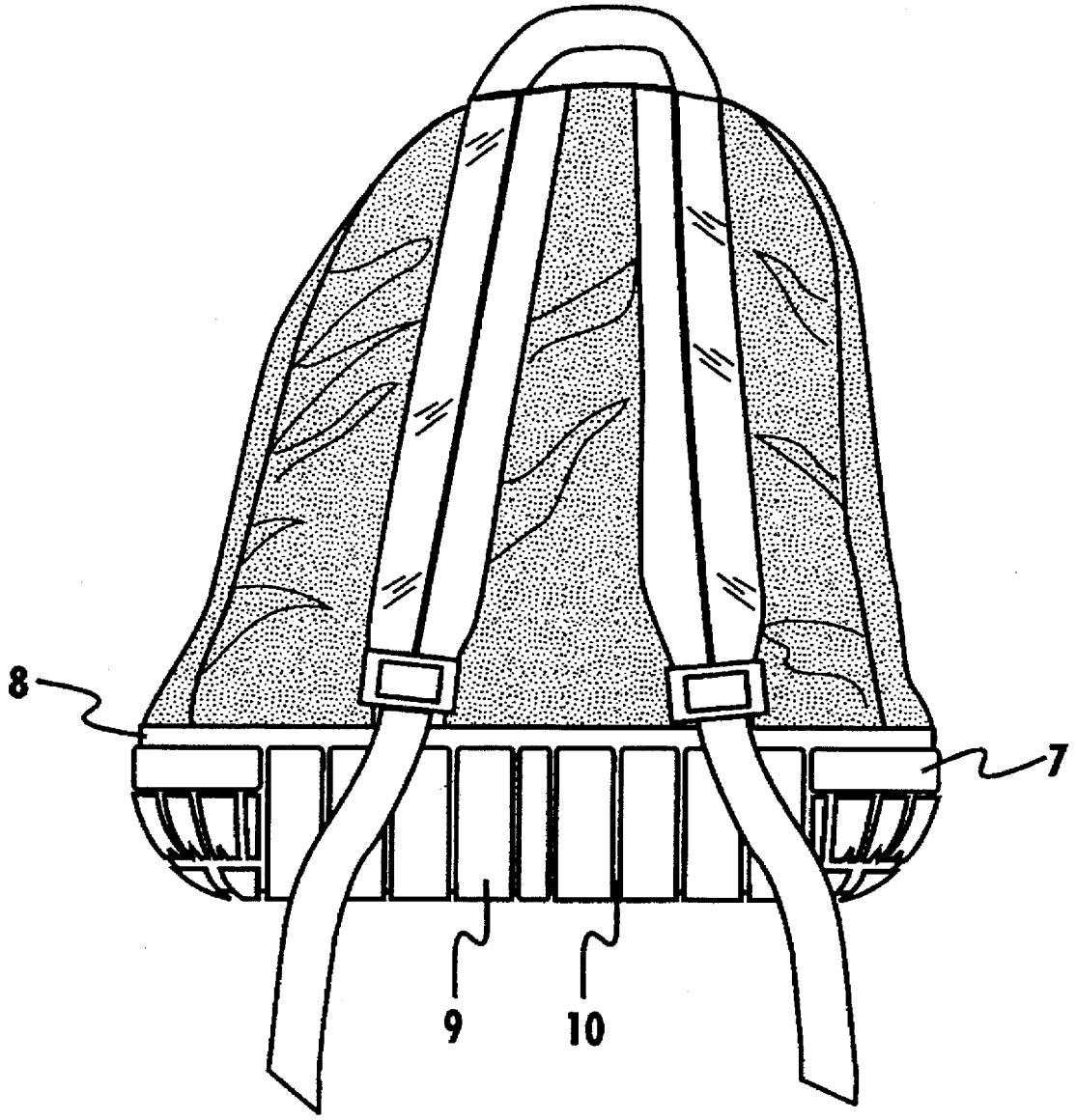
FIG. 15 is a rear view of the backpack shown in FIG. 14.
Figure 16:
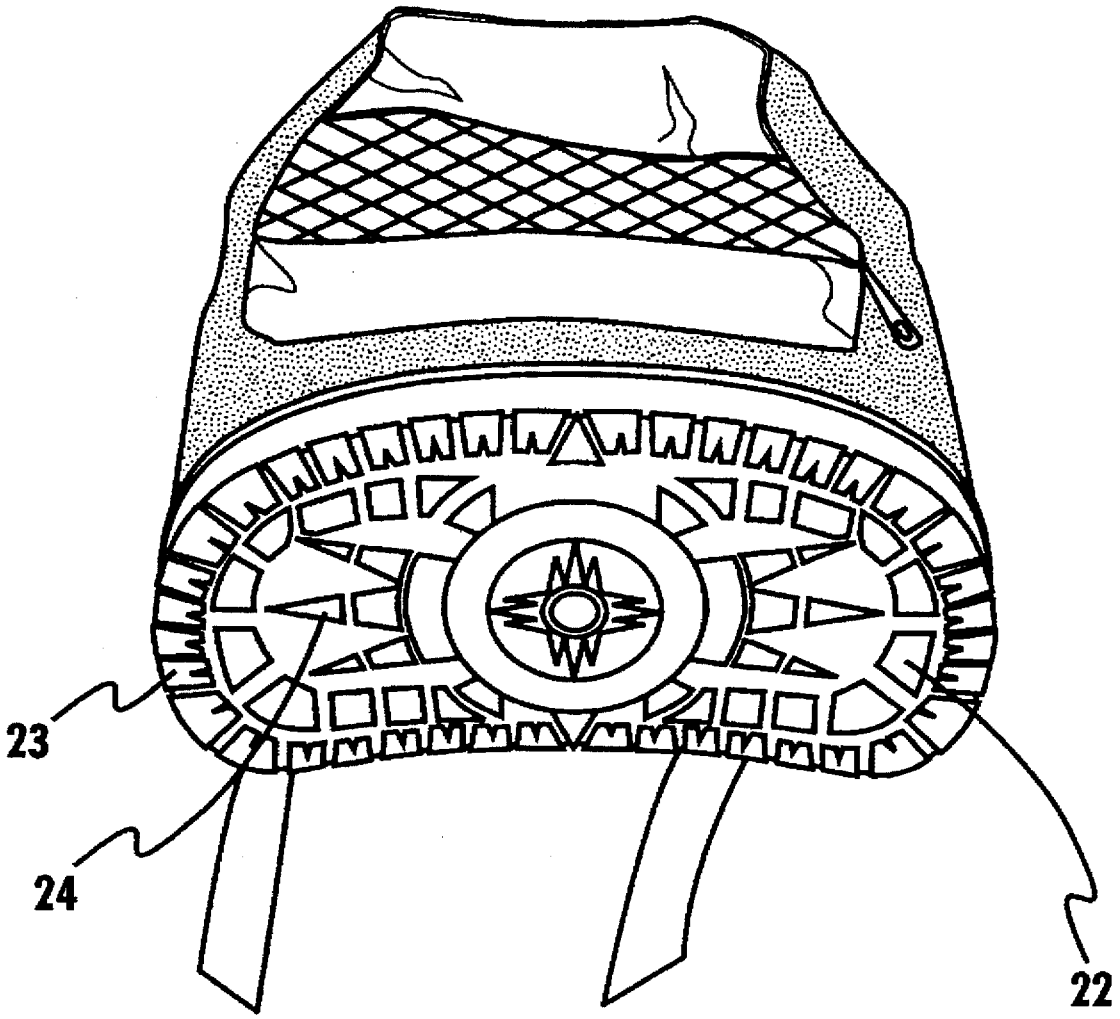
FIG. 16 is a bottom perspective view of the backpack shown in FIG. 14.
Figure 17:
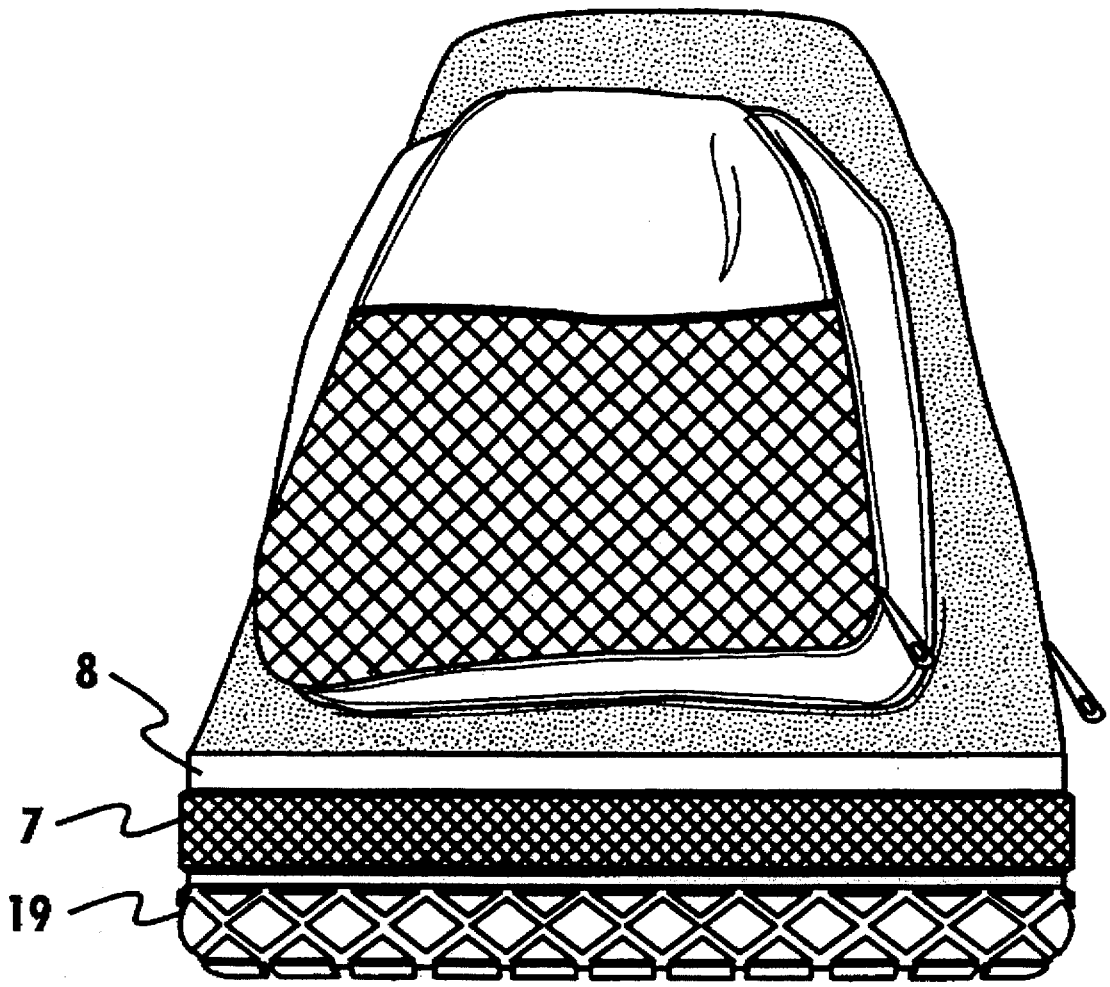
FIG. 17 is a front perspective view of a backpack with the molded rubber base of the third embodiment (see FIG. 10) of this invention.
Figure 18:
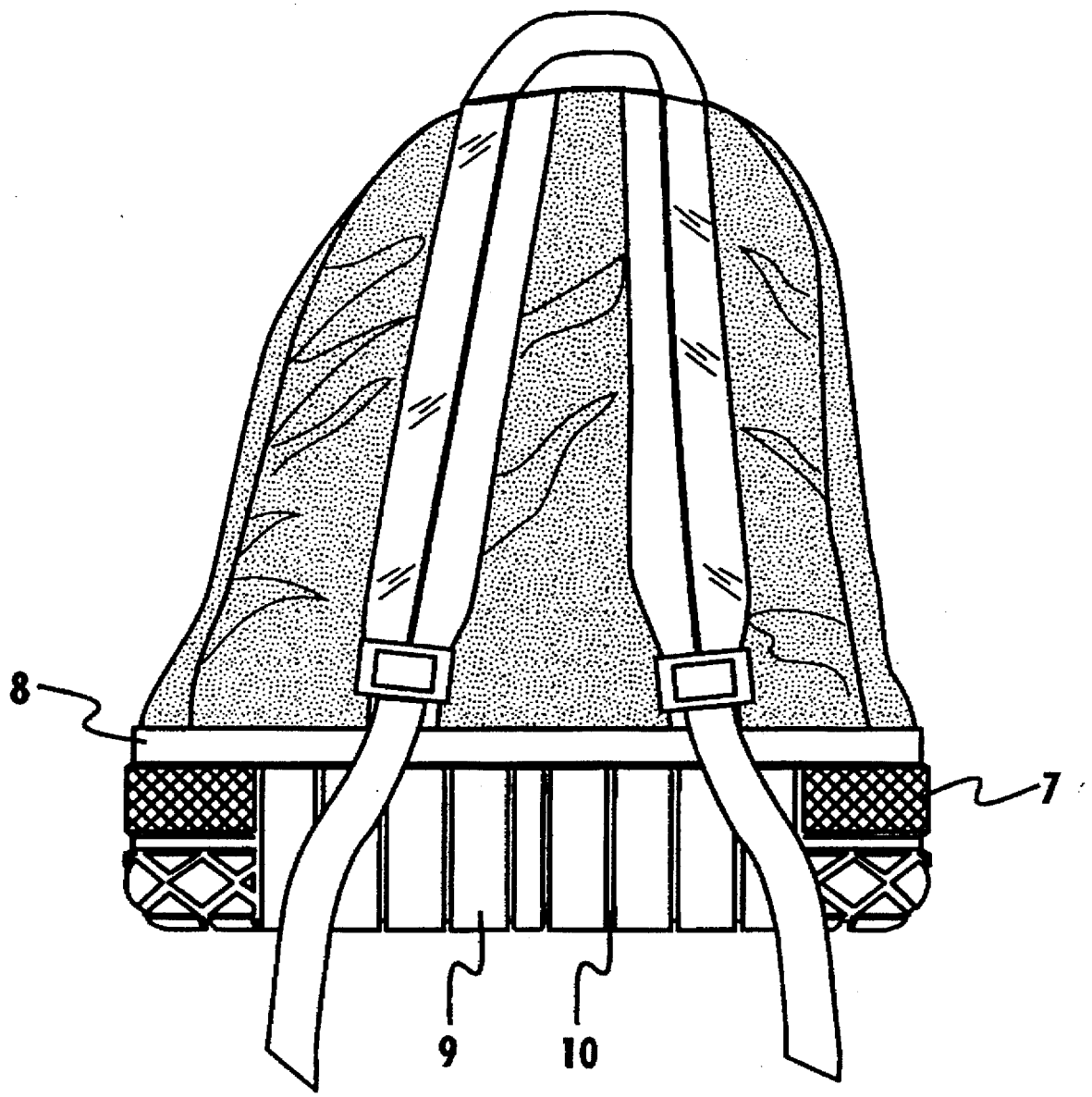
FIG. 18 is a rear view of the backpack shown in FIG. 17.
Figure 19:
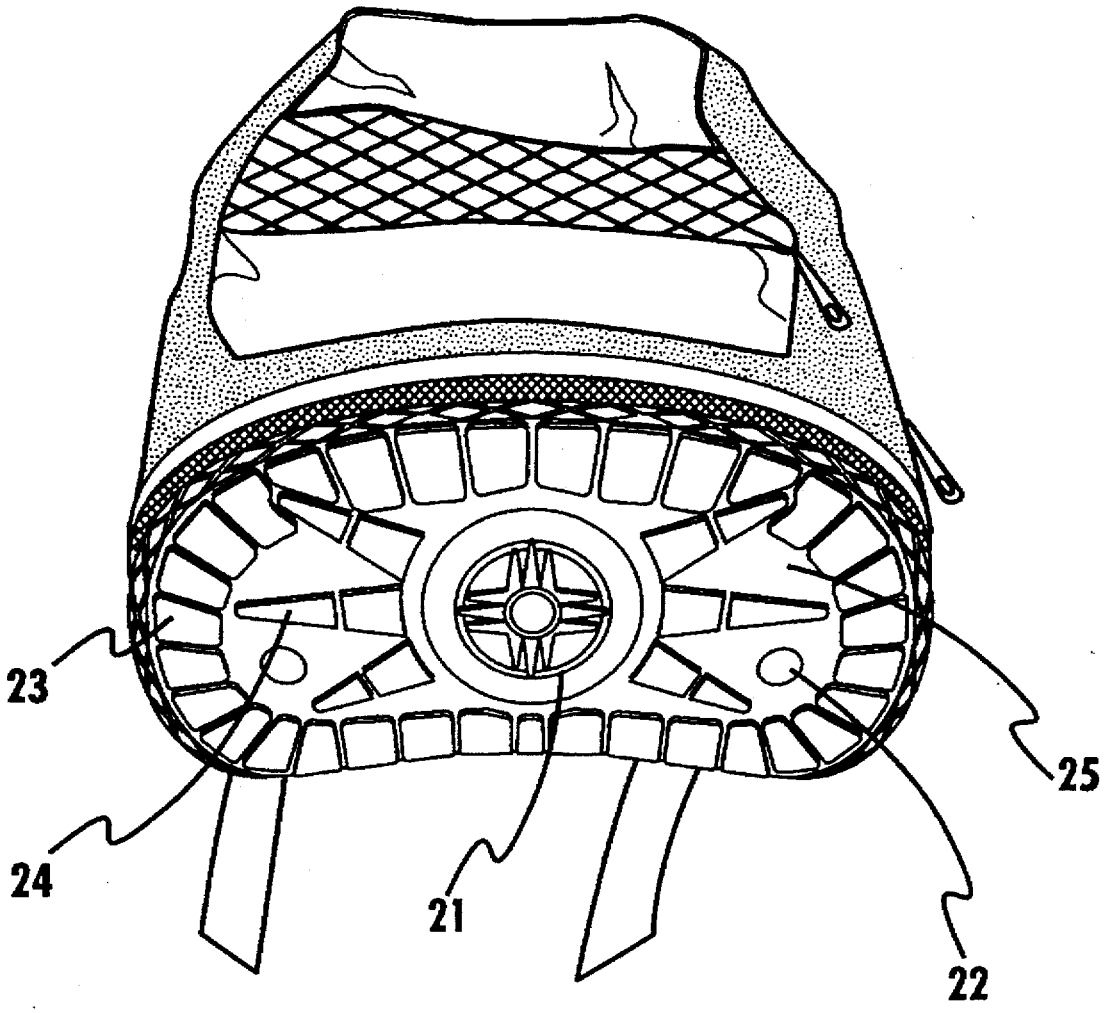
FIG. 19 is a bottom perspective view of the backpack shown in FIG. 17.

The molded rubber base of this invention can be attached to various kinds of luggage, such as daypacks, backpacks, travel bags and the like. The integral, single piece construction of the base substantially increases the durability of the luggage and adds to its appeal as well. For example, FIGS. 14–16 show a backpack with the molded rubber base as of the second embodiment of this invention. The upper body portion of the backpack is sewn to the top sewing area 8 of the base. The molded rubber base increases the durability of the backpack by separating the body of the backpack from the bottom which undergoes the greatest wear and tear. The air channels 10 for ventilation, as shown in FIG. 11, keep the backpack cooler than a solid back when carded by the user on his back. The tread pattern on the bottom (FIG. 12) allows for a large area of the rubber base of the backpack to touch the ground. The tread pattern also evokes the style and durability of hiking boots in the eyes of the consumer and adds to the appeal of the backpack. FIGS. 17–19 show a backpack with the molded rubber base of the third embodiment of this invention. As seen from the three embodiments of this invention, the design of the tread pattern on the four sidewalls and the bottom can be easily modified to change the look, appeal and utility of the backpack.

What is claimed is:

1. A base for a backpack comprising:

a bottom having a major axis and a minor axis, a front wall, a back wall, two opposed side walls connected between said front and back walls, and an open top to define an outside for said base and a hollow interior, said base being, substantially symmetrical with respect to said minor axis;

said bottom of said base being non-perforated and generally flat and connecting up to said front, back and side walls to form a single, integral structure;

said back wall of said base being laterally and vertically contoured to conform to the curvature of a user's back;

said bottom, front and side walls of said base having a tread pattern on said outside; and said back wall further comprising channels extending generally vertically on said outside of said base for air flow and ventilation between said back wall and a backpack user.

2. The base of claim 1 wherein:

said base is a monolithic, molded rubber structure.

3. The base of claim 1 wherein:

said front, back and side walls include a portion along said top which is recessed inwardly of said outside of said base to define a sewing area for sewing said base to a fabric body portion of said backpack.

4. A base for a backpack comprising:

a bottom having a major axis and a minor axis, a front wall, a back wall, two opposed side walls connected between said front and back walls, and an open top to define an outside for said base and a hollow interior, said base being substantially symmetrical with respect to said minor axis;

said bottom of said base being non perforated and generally flat and connecting up to said front, back and side walls to form a single, integral structure;

said back wall of said base being laterally and vertically contoured to conform to the curvature of a user's back; and said bottom, front and side walls of said base having a tread pattern on said outside, wherein said bottom further comprises a raised cross-hatch pattern on said interior of said base.

5. The base of claim 4 wherein:

said raised cross-hatch pattern in said interior of said base is disposed along the entirety of said interior to support the contents of said backpack and to prevent contact with said bottom of said base.

6. A backpack comprising:

an upper body for overlying a substantial portion of a user's back from side to side and from the waist to the shoulders of the user, and having an open bottom;

a base with a bottom, a front wall, a back wall, two opposed side walls connected between said front and back walls, and an open top to define an outside for said base and a hollow interior;

said bottom of said base being non-perforated and generally flat and connecting up to said front, back and side walls to form a single, integral structure;

said back wall of said base being laterally and vertically contoured to conform to the curvature of a user's back;

said bottom, front and side walls of said base having a tread pattern on said outside;

said open bottom of said upper body being connected to said top of said base to form said backpack; and said back wall of said base further comprises channels extending generally vertically on said outside of said base for air flow and ventilation between said back wall and a backpack user.

7. The backpack of claim 6 wherein:

said front, back and side walls of said base include a portion along said top which is recessed inwardly of said outside of said base to define a sewing area for sewing said base to said upper body portion of said backpack.

8. The backpack of claim 6 wherein:

said base is a monolithic, molded rubber structure.

9. A backpack comprising:

an upper body for overlying a substantial portion of a user 's back from side to side and from the waist to the shoulders of the user, and having an open bottom;

a base with a bottom, a front wall, a back wall, two opposed side walls connected between said front and back walls, and an open top to define an outside for said base and a hollow interior;

said bottom of said base being non-perforated and generally flat and connecting up to said front, back and side walls to form a single, integral structure;

said back wall of said base being laterally and vertically contoured to conform to the curvature of a user's back;

said bottom, front and side walls of said base having a tread pattern on said outside; and said upper body being connected to said top of said base to form said backpack, wherein said bottom of said base further comprises a raised cress-hatch pattern on said interior of said base, said raised cross-hatch pattern being disposed along the entirety of said bottom to support the contents of said backpack and to prevent contact with said bottom of said base.

10. A base for a backpack comprising:

a bottom having a major axis and a minor axis, a front wall, a back wall, two opposed side walls connected between said front and back walls, and an open top to define an outside for said base and a hollow interior, said base being substantially symmetrical with respect to said minor axis;

said bottom of said base being non-perforated and generally flat and connecting up to said front, back and side walls to form a single, integral structure; and said bottom further comprising a raised cross-hatch pattern on said interior of said base.

11. The base for a backpack of claim 10 wherein at least one of said bottom, front wall, back wall and side walls of said base has a tread pattern on said outside thereof.

12. A backpack comprising:

an upper body for overlying a substantial portion of a user's back from side to side and from the waist to the shoulders of the user;

a base with a bottom, a front wall, a back wall, two opposed side walls connected between said front and back walls, and an open top to define an outside for said base and a hollow interior;

said bottom of said base being non-perforated and generally flat and connecting up to said front, back and side walls to form a single, integral structure;

said upper body being connected to said top of said base to form said backpack; and said bottom of said base further comprising a raised cross-hatch pattern disposed along the entirety of the interior of said base to support the contents of said backpack and to prevent contact with said bottom of said base.

13. The backpack of claim 12 wherein at least one of said bottom, front wall, back wall and side walls of said base has a tread pattern on said outside thereof.

14. A base for a backpack comprising:

a bottom having a major axis and a minor axis, a front wall, a back wall, two opposed side walls connected between said front and back walls, and an open top to define an outside for said base and a hollow interior, said base being substantially symmetrical with respect to said minor axis;

said bottom of said base being non-perforated and generally flat and connecting up to said front, back and side walls to form a single, integral structure;

said bottom, front and side walls of said base having a tread pattern on said outside; and said back wall of said base further comprising channels extending generally vertically on said outside of said base for air flow and ventilation between said back wall the backpack user.

15. A backpack comprising:

an upper body for overlying a substantial portion of a user's back from side to side and from the waist to the shoulders of the user, and having an open bottom;

a base with a bottom, a front wall, a back wall, two opposed side walls connected between said front and back walls, and an open top to define an outside for said base and a hollow interior;

said bottom of said base being non-perforated and generally flat and connecting up to said front, back and side walls to form a single, integral structure;

said bottom, front and side walls of said base having a tread pattern on said outside;

said open bottom of said upper body being connected to said top of said base to form said backpack; and said back wall of said base further comprises channels extending generally vertically on said outside of said base for air flow and ventilation between said back wall and the backpack user.

16. A base for a backpack comprising:

a bottom having a major axis and a minor axis having an outer periphery, a front wall, a back wall, two opposed side walls connected between said front and back walls, and an open top to define an outside for said base and a hollow interior, said base being substantially symmetrical with respect to said minor axis;

said bottom of said base being non-perforated and generally flat and connecting up to said front, back and side walls along its periphery to form a single, integral structure; and said bottom, front and side walls of said base having a tread pattern on said outside with at least part of tread pattern being comprised of protruding separate pads separated by channels extending to the periphery of said bottom, at least some of said channels being interconnected along said bottom.

17. A backpack comprising:

an upper body with an open bottom;

a base with a bottom having an outer periphery, a front wall, a back wall, two opposed side walls connected between said front and back walls, and an open top to define an outside for said base and a hollow interior;

said bottom of said base being non-perforated and generally flat and connecting up to said front, back and side walls along its periphery to form a single, integral structure; and said bottom, front and side walls of said base having a tread pattern on said outside with at least part of tread pattern being comprised of protruding separate pads separated by channels extending to the periphery of said bottom, at least some of said channels being interconnected along said bottom and some of said pads and channels extending continuously along part of said bottom, front and side walls of said base; and said open bottom of said upper body being connected to said open top of said base to form said backpack.

18. A backpack of claim 17 wherein said pads each have an outer flat surface lying in a single plane.

19. The backpack of claim 18 wherein said back wall of said base is laterally and vertically contoured to conform to a user's back.

20. A backpack of any one of claims 6, 9, 19, 12, 15 and 17 wherein:

said bottom has an axis extending generally perpendicular to a user's back; and said base is substantially symmetrical with respect to said axis.

21. A luggage pack comprising:

an upper body;

a base with a bottom having a first axis and a second axis extending perpendicular to said first axis, a front wall, a back wall, two opposed side walls connected between said front and back walls, and an open top to define an outside for said base and a hollow interior, said base being substantially symmetrical with respect to one of said axes;

said bottom of said base being non-perforated and generally flat and connecting up to said front, back and side walls to form a single, integral structure;

said upper body being connected to said top of said base to form said luggage pack; and said bottom of said base further comprising a raised cross-hatch pattern disposed along the entirety of the interior of said base to support the contents of said luggage pack and to prevent contact with said bottom of said base.

22. A luggage pack comprising:

an upper body with an open bottom;

a base with a bottom having an outer periphery, a front wall, a back wall, two opposed side walls connected between said front and back walls, and an open top to define an outside for said base and a hollow interior;

said bottom of said base being non-perforated and generally flat and connecting up to said front, back and side walls along its periphery to form a single, integral structure; and said bottom, front and side walls of said base having a tread pattern on said outside with at least part of tread pattern being comprised of protruding separate pads separated by channels extending to the periphery of said bottom, at least some of said channels being interconnected along said bottom and some of said pads and channels extending continuously along part of said bottom, front and side walls of said base; and said open bottom of said upper body being connected to said open top of said base to form said luggage pack.

* * * * *